US007631691B2

(12) United States Patent
Symington et al.

(10) Patent No.: US 7,631,691 B2
(45) Date of Patent: Dec. 15, 2009

(54) METHODS OF TREATING A SUBTERRANEAN FORMATION TO CONVERT ORGANIC MATTER INTO PRODUCIBLE HYDROCARBONS

(75) Inventors: William A. Symington, Houston, TX (US); Abdel Wadood M El-Rabaa, Houston, TX (US); Robert D. Kaminsky, Houston, TX (US); William P. Meurer, Pearland, TX (US); Quinn Passey, Kingwood, TX (US); Michele M. Thomas, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 12/011,456

(22) Filed: Jan. 25, 2008

(65) Prior Publication Data

US 2008/0173443 A1 Jul. 24, 2008

Related U.S. Application Data

(63) Continuation-in-part of application No. 10/558,068, filed as application No. PCT/US2004/011508 on Apr. 14, 2004, now Pat. No. 7,331,385.

(60) Provisional application No. 60/482,135, filed on Jun. 24, 2003, provisional application No. 60/511,994, filed on Oct. 16, 2003.

(51) Int. Cl.
*E21B 43/237* (2006.01)

(52) U.S. Cl. ..... 166/248; 166/308.1

(58) Field of Classification Search ..... 166/248, 166/272.1, 272.2, 263, 279, 308
See application file for complete search history.

(56) References Cited

U.S. PATENT DOCUMENTS 363,419 A 5/1887 Poetsch (Continued)

FOREIGN PATENT DOCUMENTS

CA 994694 8/1976

(Continued)

OTHER PUBLICATIONS

Allred, (1964) "Some Characteristic Properties of Colorado Oil Shale Which May Influence In Situ Processing," *Quarterly Colo. School Of Mines, 1st Symposium Oil Shale*, v.59. No. 3, pp. 47-75.

(Continued)

*Primary Examiner*—David J Bagnell
*Assistant Examiner*—Nicole A Coy

(57) ABSTRACT

Methods are provided that include the steps of providing wells in a formation, establishing one or more fractures in the formation, such that each fracture intersects at least one of the wells, placing electrically conductive material in the fracture, and applying an electric voltage across the fracture and through the material such that sufficient heat is generated by electrical resistivity within the material to heat and/or pyrolyze organic matter in the formation to form producible hydrocarbons.

31 Claims, 4 Drawing Sheets

U.S. PATENT DOCUMENTS

| | | | | | |
|---|---|---|---|---|---|
| 1,342,780 | A | | 6/1920 | Vedder | |
| 1,422,204 | A | | 7/1922 | Hoover et al. | |
| 1,666,488 | A | | 4/1928 | Crawshaw | |
| 1,701,884 | A | | 2/1929 | Hogle | |
| 1,872,906 | A | | 8/1932 | Doherty | |
| 2,033,560 | A | | 3/1936 | Wells | 166/1 |
| 2,033,561 | A | | 3/1936 | Wells | 166/21 |
| 2,634,961 | A | | 4/1953 | Ljungstrom | 262/3 |
| 2,732,195 | A | | 1/1956 | Ljungstrom | 262/3 |
| 2,777,679 | A | | 1/1957 | Ljungstrom | 262/3 |
| 2,780,450 | A | | 2/1957 | Ljungstrom | 262/3 |
| 2,795,279 | A | * | 6/1957 | Sarapuu | 166/248 |
| 2,812,160 | A | | 11/1957 | West et al. | 255/1.4 |
| 2,847,071 | A | | 8/1958 | De Priester | 166/39 |
| 2,887,160 | A | | 5/1959 | De Priester et al. | 166/59 |
| 2,895,555 | A | | 7/1959 | De Priester | 166/59 |
| 2,923,535 | A | | 2/1960 | Ljungstrom | 262/3 |
| 2,944,803 | A | | 7/1960 | Hanson | 262/3 |
| 2,952,450 | A | | 9/1960 | Purre | 262/3 |
| 3,004,601 | A | | 10/1961 | Bodine | 166/39 |
| 3,013,609 | A | | 12/1961 | Brink | 166/39 |
| 3,095,031 | A | | 6/1963 | Eurenius et al. | 158/99 |
| 3,106,244 | A | * | 10/1963 | Parker | 166/248 |
| 3,109,482 | A | | 11/1963 | O'Brien | 158/115 |
| 3,127,936 | A | | 4/1964 | Eurenius | 166/39 |
| 3,137,347 | A | * | 6/1964 | Parker | 166/248 |
| 3,149,672 | A | | 9/1964 | Orkiszewski et al. | 166/39 |
| 3,180,411 | A | | 4/1965 | Parker | 166/11 |
| 3,183,675 | A | | 5/1965 | Schroeder | 61/36 |
| 3,194,315 | A | | 7/1965 | Rogers | 166/57 |
| 3,225,829 | A | | 12/1965 | Chown et al. | 166/59 |
| 3,241,611 | A | | 3/1966 | Dougan | 166/7 |
| 3,241,615 | A | | 3/1966 | Brandt et al. | 166/59 |
| 3,254,721 | A | | 6/1966 | Smith et al. | 166/59 |
| 3,256,935 | A | | 6/1966 | Nabor et al. | 166/9 |
| 3,267,680 | A | | 8/1966 | Schlumberger | 61/36 |
| 3,271,962 | A | | 9/1966 | Dahms et al. | 61/36 |
| 3,284,281 | A | | 11/1966 | Thomas | 166/2 |
| 3,294,167 | A | | 12/1966 | Vogel | 166/11 |
| 3,295,328 | A | | 1/1967 | Bishop | 61/0.5 |
| 3,372,550 | A | | 3/1968 | Schroeder | 61/36 |
| 3,376,403 | A | | 4/1968 | Mircea | 219/10.49 |
| 3,400,762 | A | | 9/1968 | Peacock et al. | 166/11 |
| 3,436,919 | A | | 4/1969 | Shock et al. | 61/0.5 |
| 3,468,376 | A | | 9/1969 | Slusser et al. | 166/272 |
| 3,500,913 | A | | 3/1970 | Nordgren et al. | 166/259 |
| 3,501,201 | A | | 3/1970 | Closmann et al. | 299/4 |
| 3,513,914 | A | | 5/1970 | Vogel | 166/271 |
| 3,528,252 | A | | 9/1970 | Gail | 61/36 |
| 3,559,737 | A | | 2/1971 | Ralstin et al. | 166/281 |
| 3,599,714 | A | | 8/1971 | Messman | 166/258 |
| 3,602,310 | A | | 8/1971 | Halbert | 166/303 |
| 3,613,785 | A | | 10/1971 | Closmann et al. | 166/271 |
| 3,620,300 | A | * | 11/1971 | Crowson | 166/248 |
| 3,642,066 | A | * | 2/1972 | Gill | 166/248 |
| 3,692,111 | A | | 9/1972 | Breithaupt et al. | 166/252 |
| 3,729,965 | A | | 5/1973 | Gartner | 70/395 |
| 3,741,306 | A | | 6/1973 | Papadopoulos | 166/252 |
| 3,759,329 | A | | 9/1973 | Ross | 166/308.1 |
| 3,882,937 | A | | 5/1975 | Robinson | 166/267 |
| 3,943,722 | A | | 3/1976 | Ross | 61/36 |
| 3,950,029 | A | | 4/1976 | Timmins | 299/2 |
| 3,978,920 | A | | 9/1976 | Bandyopadhyay | 166/258 |
| 4,003,432 | A | | 1/1977 | Paull et al. | 166/271 |
| 4,005,750 | A | | 2/1977 | Shuck | 166/308 |
| 4,030,549 | A | | 6/1977 | Bouck | 166/280 |
| 4,067,390 | A | | 1/1978 | Camacho et al. | 166/302 |
| 4,071,278 | A | | 1/1978 | Carpenter et al. | 299/5 |
| 4,125,159 | A | | 11/1978 | Vann | 166/285 |
| 4,140,180 | A | | 2/1979 | Bridges et al. | 166/248 |
| 4,239,283 | A | | 12/1980 | Ridley | 299/2 |
| 4,265,310 | A | | 5/1981 | Britton et al. | 166/259 |
| 4,272,127 | A | | 6/1981 | Hutchins | 299/2 |
| 4,319,635 | A | | 3/1982 | Jones | 166/263 |
| 4,320,801 | A | | 3/1982 | Rowland et al. | 166/248 |
| 4,358,222 | A | | 11/1982 | Landau | 405/130 |
| 4,368,921 | A | | 1/1983 | Hutchins | 299/2 |
| 4,372,615 | A | | 2/1983 | Ricketts | 299/2 |
| 4,397,502 | A | | 8/1983 | Hines | 299/2 |
| 4,401,162 | A | | 8/1983 | Osborne | 166/248 |
| 4,412,585 | A | * | 11/1983 | Bouck | 166/248 |
| 4,457,365 | A | * | 7/1984 | Kasevich et al. | 166/60 |
| 4,473,114 | A | * | 9/1984 | Bell et al. | 166/248 |
| 4,474,238 | A | | 10/1984 | Gentry et al. | 166/268 |
| 4,485,869 | A | * | 12/1984 | Sresty et al. | 166/248 |
| 4,487,257 | A | | 12/1984 | Dauphine | 166/60 |
| 4,487,260 | A | | 12/1984 | Pittman et al. | 166/259 |
| 4,550,779 | A | | 11/1985 | Zakiewicz | 166/248 |
| 4,567,945 | A | * | 2/1986 | Segalman | 166/248 |
| 4,589,491 | A | | 5/1986 | Perkins | 166/302 |
| 4,607,488 | A | | 8/1986 | Karinthi et al. | 62/45 |
| 4,626,665 | A | | 12/1986 | Fort | 219/534 |
| 4,634,315 | A | | 1/1987 | Owen et al. | 405/217 |
| 4,640,352 | A | | 2/1987 | Vanmeurs et al. | 166/245 |
| 4,694,907 | A | | 9/1987 | Stahl et al. | 166/303 |
| 4,704,514 | A | | 11/1987 | Van Egmond et al. | 219/278 |
| 4,705,108 | A | | 11/1987 | Little et al. | 166/248 |
| 4,747,642 | A | | 5/1988 | Gash et al. | 299/11 |
| 4,754,808 | A | | 7/1988 | Harmon et al. | 166/254 |
| 4,860,544 | A | | 8/1989 | Krieg et al. | 62/45 |
| 4,886,118 | A | | 12/1989 | Van Meurs et al. | 166/245 |
| 4,926,941 | A | | 5/1990 | Glandt et al. | 166/248 |
| 4,974,425 | A | | 12/1990 | Krieg et al. | 62/45.1 |
| 5,016,709 | A | | 5/1991 | Combe et al. | 166/245 |
| 5,050,386 | A | | 9/1991 | Krieg et al. | 62/45.1 |
| 5,255,742 | A | | 10/1993 | Mikus | 166/303 |
| 5,297,626 | A | | 3/1994 | Vinegar et al. | 166/271 |
| 5,305,829 | A | | 4/1994 | Kumar | 166/245 |
| 5,392,854 | A | | 2/1995 | Vinegar et al. | 166/271 |
| 5,411,089 | A | | 5/1995 | Vinegar et al. | 166/272 |
| 5,416,257 | A | | 5/1995 | Peters | 588/1 |
| 5,620,049 | A | | 4/1997 | Gipson et al. | 166/248 |
| 5,730,550 | A | | 3/1998 | Andersland et al. | 405/128 |
| 5,899,269 | A | | 5/1999 | Wellington et al. | 166/58 |
| 6,023,554 | A | | 2/2000 | Vinegar et al. | 392/301 |
| 6,148,911 | A | | 11/2000 | Gipson et al. | 166/248 |
| 6,581,684 | B2 | | 6/2003 | Wellington et al. | 166/245 |
| 6,607,036 | B2 | | 8/2003 | Ranson et al. | 166/302 |
| 6,684,644 | B2 | | 2/2004 | Mittricker et al. | 60/772 |
| 6,708,758 | B2 | | 3/2004 | de Rouffignac et al. | 166/245 |
| 6,712,136 | B2 | | 3/2004 | de Rouffignac et al. | 166/245 |
| 6,722,429 | B2 | | 4/2004 | de Rouffignac et al. | 166/245 |
| 6,742,588 | B2 | | 6/2004 | Wellington et al. | 166/245 |
| 6,745,832 | B2 | | 6/2004 | Wellington et al. | 166/245 |
| 6,782,947 | B2 | | 8/2004 | de Rouffignac et al. | 166/245 |
| 6,796,139 | B2 | | 9/2004 | Briley et al. | 62/260 |
| 6,854,929 | B2 | | 2/2005 | Vinegar et al. | 405/129.65 |
| 6,858,049 | B2 | | 2/2005 | Mittricker | 48/127.7 |
| 6,880,633 | B2 | | 4/2005 | Wellington et al. | 166/245 |
| 6,887,369 | B2 | | 5/2005 | Moulton et al. | 208/107 |
| 6,896,053 | B2 | | 5/2005 | Berchenko et al. | 166/245 |
| 6,913,078 | B2 | | 7/2005 | Shahin et al. | 166/245 |
| 6,918,444 | B2 | | 7/2005 | Passey et al. | 166/258 |
| 6,923,258 | B2 | | 8/2005 | Wellington et al. | 166/245 |
| 6,932,155 | B2 | | 8/2005 | Vinegar et al. | 166/245 |
| 6,948,562 | B2 | | 9/2005 | Wellington et al. | 166/272.1 |
| 6,953,087 | B2 | | 10/2005 | de Rouffignac et al. | 166/245 |
| 6,964,300 | B2 | | 11/2005 | Vinegar et al. | 166/245 |
| 6,969,123 | B2 | | 11/2005 | Vinegar et al. | 299/3 |
| 7,011,154 | B2 | | 3/2006 | Maher et al. | 166/245 |
| 7,032,660 | B2 | | 4/2006 | Vinegar et al. | 166/245 |
| 7,036,583 | B2 | | 5/2006 | de Rouffignac et al. | 166/245 |
| 7,066,254 | B2 | | 6/2006 | Vinegar et al. | 166/245 |
| 7,073,578 | B2 | | 7/2006 | Vinegar et al. | 166/245 |

| | | | | |
|---|---|---|---|---|
| 7,077,198 | B2 | 7/2006 | Vinegar et al. | 166/245 |
| 7,077,199 | B2 | 7/2006 | Vinegar et al. | 166/250.1 |
| 7,093,655 | B2 | 8/2006 | Atkinson | 166/266 |
| 7,096,942 | B1 | 8/2006 | de Rouffignac et al. | 166/245 |
| 7,096,953 | B2 | 8/2006 | de Rouffignac et al. | 166/302 |
| 7,104,319 | B2 | 9/2006 | Vinegar et al. | 166/245 |
| 7,121,342 | B2 | 10/2006 | Vinegar et al. | 166/302 |
| 7,225,866 | B2 | 6/2007 | Berchenko et al. | 166/245 |
| 7,331,385 | B2 | 2/2008 | Symington et al. | 166/248 |
| 7,357,180 | B2 | 4/2008 | Vinegar et al. | 166/254.1 |
| 7,441,603 | B2 | 10/2008 | Kaminsky et al. | 166/308.1 |
| 7,516,785 | B2 | 4/2009 | Kaminsky | 166/245 |
| 7,516,787 | B2 | 4/2009 | Kaminsky | 166/250.1 |
| 2005/0269077 | A1 | 12/2005 | Sandberg | 166/249 |
| 2007/0045265 | A1 | 3/2007 | McKinzie, II | 219/207 |
| 2007/0144732 | A1 | 6/2007 | Kim et al. | 166/245 |
| 2007/0209799 | A1 | 9/2007 | Vinegar et al. | 166/302 |
| 2007/0246994 | A1 | 10/2007 | Symington et al. | 299/3 |
| 2008/0087420 | A1 | 4/2008 | Symington et al. | 166/245 |
| 2008/0087421 | A1 | 4/2008 | Kaminsky | 166/245 |
| 2008/0087426 | A1 | 4/2008 | Kaminsky | 166/271 |
| 2008/0087427 | A1 | 4/2008 | Symington et al. | 166/272.1 |
| 2008/0087428 | A1 | 4/2008 | Symington et al. | 166/272.2 |
| 2008/0173443 | A1 | 7/2008 | Symington et al. | 166/248 |
| 2008/0207970 | A1 | 8/2008 | Meurer et al. | 484/24 |
| 2008/0230219 | A1 | 9/2008 | Kaminsky | 166/248 |
| 2008/0271885 | A1 | 11/2008 | Kaminsky | 166/245 |
| 2008/0283241 | A1 | 11/2008 | Kaminsky et al. | 166/245 |
| 2008/0289819 | A1 | 11/2008 | Kaminsky et al. | 166/256 |
| 2008/0290719 | A1 | 11/2008 | Symington et al. | 299/3 |
| 2009/0050319 | A1 | 2/2009 | Kaminsky et al. | 166/257 |

FOREIGN PATENT DOCUMENTS

| | | | |
|---|---|---|---|
| CA | 1288043 | 8/1991 | 166/38 |
| EP | 0387846 | 9/1990 | |
| FR | 0866212 | 9/1998 | |
| GB | 855408 | 11/1960 | |
| GB | 1463444 | 2/1977 | |
| GB | 1559948 | 1/1980 | |
| GB | 1595082 | 8/1981 | |
| WO | WO 82/01408 | 4/1982 | |
| WO | WO 90/06480 | 6/1990 | |
| WO | WO 01/081505 | 11/2001 | |
| WO | WO 2005/010320 | 2/2005 | |
| WO | WO 2005/045192 | 5/2005 | |

OTHER PUBLICATIONS

Baugman, G. L. (1978) *Synthetic Fuels Data Handbook*, Second Edition, Cameron Engineers Inc.

Berry, K. L., et al. (1982) "Modified in situ retorting results of two field retorts", Gary, J. H., ed., 15th Oil Shale Symp., CSM, pp. 385-396.

Boyer, H. E. et al. (1985) "Chapter 16: Heat-Resistant Materials," *Metals Handbook*, American Society for Metals, 16 pages.

Brandt, H. et al. (1965) "Stimulating Heavy Oil Reservoirs With Downhole Air-Gas Burners," *World Oil*, (Sep. 1965), pp. 91-95.

Bridges, J. E., et al. (1983) "The IITRI in situ fuel recovery process", *J. Microwave Power*, v. 18, pp. 3-14.

Burnham, A. K. et al. (1983) "High-Pressure Pyrolysis of Green River Oil Shale" in Geochemistry and Chemistry of Oil Shales: ACS Symposium Series.

Burwell, E. L. et al. (1970) "Shale Oil Recovery by In-Situ Retorting—A Pilot Study" Journal of Petroleum Engr., Dec. 1970, pp. 1520-1524.

Chute, F. S., and Vermeulen, F. E., (1988) "Present and potential applications of electromagnetic heating in the in situ recovery of oil", AOSTRA J. Res., v. 4, pp. 19-33.

Chute, F. S. And Vermeulen, F.E., (1989) "Electrical heating of reservoirs", Hepler, L., and Hsi, C., eds., AOSTRA Technical Handbook on Oil Sands, Bitumens, and Heavy Oils, Chapt. 13, pp. 339-376.

Cook, G. L. et al. (1968) "The Composition of Green River Shale Oils" United Nations Symposium of the Development and Utilization of Oil Shale Resources, 23 pgs.

Covell, J. R., et al. (1984) "Indirect in situ retorting of oil shale using the TREE process", Gary, J. H., ed., 17th Oil Shale Symposium Proceedings, Colorado School of Mines, pp. 46-58. c.

Cummins, J. J. et al. (1972) "Thermal Degradation of Green River Kerogen at 150 to 350C: Rate of Product Formation, Report of Investigation 7620," *US Bureau of Mines*, 1972.

DePriester, C. et al. (1963) "Well Stimulation by Downhole Gas-Air Burner," *Jrnl. Petro. Tech.*, (Dec. 1963), pp. 1297-1302.

Dougan, P. M. et al. (1981) "BX In Situ Oil Shale Project," *Colorado School of Mines; Fourteenth Oil Shale Symposium Proceedings*, 1981, pp. 118-127.

Dougan, P. M. (1979) "The BX In Situ Oil Shale Project," *Chem. Engr. Progress*, pp. 81-84.

Duncan, D. C., (1967) "Geologic Setting of Oil Shale Deposits and World Prospects," *in Proceedings of the Seventh World Petroleum Congress*, v.3, Elsevier Publishing, pp. 659-667.

Fisher, S. T. (1980) "A Comparison of Eleven Processes for Production of Energy from the Solid Fossil Fuels of North America," *SPE* 9098, pp. 1-27.

Hill, G.R. et al. (1967) "The Characteristics of a Low Temperature In Situ Shale Oil," *4th Symposium on Oil Shale, Quarterly of the Colorado School of Mines*, v.62(3), pp. 641-656.

Humphrey, J. P. (1978) "Energy from in situ processing of Antrim oil shale", *DOE Report FE*-2346-29.

Ingram, L. L. et al. (1983) "Comparative Study of Oil Shales and Shale Oils from the Mahogany Zone, Green River Formation (USA) and Kerosene Creek Seam, Rundle Formation (Australia)," *Chemical Geology*, 38, pp. 185-212.

Jacobs, H. R. (1983) "Analysis of the Effectiveness of Steam Retorting of Oil Shale", *AIChE Symposium Series—Heat Transfer*—Seattle 1983 pp. 373-382.

Johnson, D. J. (1966) "Decomposition Studies of Oil Shale," *University of Utah*, May 1966.

Lekas, M. A. et al. (1991) "Initial evaluation of fracturing oil shale with propellants for in situ retorting—Phase 2", *DOE Report DOE/MC*/11076-3064.

Mut, Stephen (2005) "The Potential of Oil Shale," *Shell Oil Presentation at National Academies, Trends in Oil Supply Demand*, in Washington, DC, Oct. 20-21, 2005, 11 pages.

Needham, et al (1976) "Oil Yield and Quality from Simulated In-Situ Retorting of Green River Oil Shale", Society of Petroleum Engineers of American Institute of Mining, Metallurgical and Petroleum Engineers, Inc. SPE 6069.

Prats, M. et al. (1975) "The Thermal Conductivity and Diffusivity of Green River Oil Shales", *Journal of Petroleum Technology*, pp. 97-106, Jan. 1975.

Rajeshwar, K. et al. (1979) "Review: Thermophysical Properties of Oil Shales", *Journal of Materials Science*, v.14, pp. 2025-2052.

Riva, D. et al. (1998) "Suncor down under: the Stuart Oil Shale Project", Annual Meeting of the *Canadian Inst. of Mining, Metallurgy, and Petroleum*, Montreal, May 3-7.

Rupprecht, R. (1979) "Application of the Ground-Freezing Method to Penetrate a Sequence of Water-Bearing and Dry Formations—Three Construction Cases," *Engineering Geology*, 13, pp. 541-546.

Salamonsson, G. (1951) "The Ljungstrom In Situ Method for Shale-Oil Recovery," *2nd Oil Shale and Cannel Coal Conference*, 2, Glasgow, Scotland, Inst. of Petrol., London, pp. 260-280.

Sandberg, C. R. et al. (1962) "In-Situ Recovery of Oil from Oil Shale—A Review and Summary of Field and Laboratory Studies," RR62.039FR, Nov. 1962.

Sierra, R. et al. (2001) "Promising Progress in Field Application of Reservoir Electrical Heating Methods," *SPE 69709*, SPE Int'l Thermal Operations and Heavy Oil Symposium, Venezuela, Mar. 2001, 17 pages.

Siskin, M. et al. (1995) "Detailed Structural Characterization of the Organic Material in Rundel Ramsay Crossing and Green River Oil Shales," *Kluwer Academic Publishers*, pp. 143-158.

Smith, F. M. (1966) "A Down-hole Burner—Versatile Tool for Well Heating," *25th Tech. Conf on Petroleum Production*, Pennsylvania State Univ., pp. 275-285.

Sresty, G. C.; et al. (1982) "Kinetics of Low-Temperature Pyrolysis of Oil Shale by the IITRI RF Process," *Colorado School of Mines; Fifteenth Oil Shale Symposium Proceedings*, Aug. 1982, pp. 411-423.

Stevens, A. L., and Zahradnik, R. L. (1983) "Results from the simultaneous processing of modified in situ retorts 7& 8", Gary, J. H., ed., *16th Oil Shale Symp*., CSM, p. 267-280.

Stoss, K. et al. (1979) "Uses and Limitations of Ground Freezing With Liquid Nitrogen," *Engineering Geology*, 13, pp. 485-494.

Thomas, G. W. (1964) "A Simplified Model of Conduction Heating in Systems of Limited Permeability," *Soc.Pet. Engineering Journal*, Dec. 1964, pp. 335-344.

Thomas, G. W. (1966) "Some Effects of Overburden Pressure on Oil Shale During Underground Retorting," *Society of Petroleum Engineers Journal*, pp. 1-8, Mar. 1966.

Tihen, S. S. et al. (1967) "Thermal Conductivity and Thermal Diffusivity of Green River Oil Shale," *Thermal Conductivity: Proceedings of the Seventh Conference* (Nov. 13-16, 1967), *NBS Special Publication* 302, pp. 529-535, 1968.

Tisot, P. R. et al. (1970) "Structural Response of Rich Green River Oil Shales to Heat and Stress and Its Relationship to Induced Permeability," *Journal of Chemical Engineering Data*, v. 15(3), pp. 425-434.

Tisot, P. R. et al. (1971) "Structural Deformation of Green River Oil Shale as It Relates to In Situ Retorting," *US Bureau of Mines Report of Investigations 7576*, 1971.

Tisot, P. R. (1975) "Structural Response of Propped Fractures in Green River Oil Shale as It Relates to Underground Retorting," *US Bureau of Mines Report of Investigations 8021*.

Tissot, B. P., and Welte, D. H. (1984) *Petroleum Formation and Occurrence*, New York, Springer-Verlag, p. 160-174, 175-198 and 254-266.

Tissot, B. P., and Welte, D. H. (1984) *Petroleum Formation and Occurrence*, New York, Springer-Verlag, p. 267-289 and 470-492.

Tyner, C. E. et al. (1982) "Sandia/Geokinetics Retort 23: a horizontal in situ retorting experiment", Gary, J. H., ed., *15th Oil Shale Symp*., CSM, p. 370-384.

Yen, T. F. et al. (1976) *Oil Shale*, Amsterdam, Elsevier, p. 216-267.

Oil & Gas Journal, 1998, "Aussie oil shale project moves to Stage 2", Oct. 26, p. 42.

International Search Report for PCT/US07/21669, Apr. 29, 2008.

International Search Report for PCT/US08/083815, Mar. 20, 2009.

International Search Report for PCT/US04/11508, Jan. 5, 2005.

International Search Report for PCT/US08/88045, Feb. 12, 2009.

US Pat No. 7,516,787—Office Action mailed Apr. 3, 2008.

US Pat No. 7,516,785—Office Action mailed Apr. 2, 2008.

US Pat No. 7,331,385 —Office Action mailed Jul. 12, 2007.

U.S. Appl. No. 11/973,750 Office Action mailed Dec. 4, 2008.

EP Search Report dated Feb. 16, 2007 (RS 114807, Corresponding to U.S. Appl. No. 11/973,753).

EP Search Report dated Mar. 12, 2009 (EP 08 00 3956,-Corresponding to U.S. Appl. No. 12/271,521).

EP Search Report dated Dec. 29, 2003 (RS 110243, Corresponding to US Pat 7,331,385).

* cited by examiner

METHODS OF TREATING A SUBTERRANEAN FORMATION TO CONVERT ORGANIC MATTER INTO PRODUCIBLE HYDROCARBONS

This application is a continuation-in-part of U.S. application Ser. No. 10/558,068, filed Nov. 22, 2005, which issued as U.S. Pat. No. 7,331,385, entitled Methods of Treating a Subterranean Formation To Convert Organic Matter Into Producible Hydrocarbons, which is the National Stage Application of International Application No. PCT/US2004/011508, filed Apr. 14, 2004, which claims the benefit of both U.S. Provisional Application Nos. 60/482,135 filed on Jun. 24, 2003 and 60/511,994 filed on Oct. 16, 2003. All of the above-referenced applications are incorporated herein in their entirety by reference.

FIELD OF THE INVENTION

This invention relates to methods of treating a subterranean formation to convert organic matter into producible hydrocarbons. More particularly, this invention relates to such methods that include the steps of providing wells in the formation, establishing fractures in the formation, such that each fracture intersects at least one of the wells, placing electrically conductive material in the fractures, and generating electric current through the fractures and through the electrically conductive material such that sufficient heat is generated by electrical resistivity within the electrically conductive material to pyrolyze organic matter into producible hydrocarbons.

BACKGROUND OF THE INVENTION

A Table of References is provided herein, immediately preceding the claims. All REF. numbers referred to herein are identified in the Table of References.

Oil shales, source rocks, and other organic-rich rocks contain kerogen, a solid hydrocarbon precursor that will convert to producible oil and gas upon heating. Production of oil and gas from kerogen-containing rocks presents two primary problems. First, the solid kerogen must be converted to oil and gas that will flow through the rock. When kerogen is heated, it undergoes pyrolysis, chemical reactions that break bonds and form smaller molecules like oil and gas. The second problem with producing hydrocarbons from oil shales and other organic-rich rocks is that these rocks typically have very low permeability. By heating the rock and transforming the kerogen to oil and gas, the permeability is increased.

Several technologies have been proposed for attempting to produce oil and gas from kerogen-containing rocks.

Near-surface oil shales have been mined and retorted at the surface for over a century. In 1862, James Young began processing Scottish oil shales, and that industry lasted for about 100 years. Commercial oil shale retorting has also been conducted in other countries such as Australia, Brazil, China, Estonia, France, Russia, South Africa, Spain, and Sweden. However, the practice has been mostly discontinued in recent years because it proved to be uneconomic or because of environmental constraints on spent shale disposal (REF. 26). Further, surface retorting requires mining of the oil shale, which limits application to shallow formations.

Techniques for in situ retorting of oil shale were developed and pilot tested with the Green River oil shale in the United States. In situ processing offers advantages because it reduces costs associated with material handling and disposal of spent shale. For the in situ pilots, the oil shale was first rubblized and then combustion was carried out by air injection. A rubble bed with substantially uniform fragment size and substantially uniform distribution of void volume was a key success factor in combustion sweep efficiency. Fragment size was of the order of several inches.

Two modified in situ pilots were performed by Occidental and Rio Blanco (REF. 1; REF. 21). A portion of the oil shale was mined out to create a void volume, and then the remaining oil shale was rubblized with explosives. Air was injected at the top of the rubble chamber, the oil shale was ignited, and the combustion front moved down. Retorted oil ahead of the front drained to the bottom and was collected there.

In another pilot, the "true" in situ GEOKINETICS process produced a rubblized volume with carefully designed explosive placement that lifted a 12-meter overburden (REF. 23). Air was injected via wellbores at one end of the rubblized volume, and the combustion front moved horizontally. The oil shale was retorted ahead of the burn; oil drained to the bottom of the rubblized volume and to production wells at one end.

Results from these in situ combustion pilots indicated technical success, but the methods were not commercialized because they were deemed uneconomic. Oil shale rubblization and air compression were the primary cost drivers.

A few authors and inventors have proposed in situ combustion in fractured oil shales, but field tests, where performed, indicated a limited reach from the wellbore (REF. 10; REF. 11; REF. 17).

An in situ retort by thermal conduction from heated wellbores approach was invented by Ljungstrom in 1940 and pioneered by the Swedish Shale Oil Co. with a full scale plant that operated from 1944 into the 1950's (REF. 19; REF. 24). The process was applied to a permeable oil shale at depths of 6 to 24 m near Norrtorp, Sweden. The field was developed with hexagonal patterns, with six heater wells surrounding each vapor production well. Wells were 2.2 m apart. Electrical resistance heaters in wellbores provided heat for a period of five months, which raised the temperature at the production wells to about 400° C. Hydrocarbon vapor production began when the temperature reached 280° C. and continued beyond the heating period. The vapors condensed to a light oil product having a specific gravity of 0.87.

Van Meurs and others further developed the approach of conductive heating from wellbores (REF. 24). They patented a process to apply the approach to impermeable oil shales with heater wells at 600° C. and well spacings greater than 6 m. They propose that the heat-injection wells may be heated either by electrical resistance heaters or by gas-fired combustion heaters. The inventors performed field tests in an outcropping oil shale formation with wells 6 to 12 m deep and 0.6 m apart. After three months, temperatures reached 300° C. throughout the test area. Oil yields were 90% of Fischer Assay. The inventors observed that permeability increased between the wellbores, and they suggest that it may be a result of horizontal fractures formed by the volume expansion of the kerogen to hydrocarbon reaction.

Because conductive heating is limited to distances of several meters, conductive heating from wellbores must be developed with very closely spaced wells. This limits economic application of the process to very shallow oil shales (low well costs) and/or very thick oil shales (higher yield per well).

Covell and others proposed retorting a rubblized bed of oil shale by gasification and combustion of an underlying coal seam (REF. 5). Their process named Total Resource Energy Extraction (TREE), called for upward convection of hot flue gases (727° C.) from the coal seam into the rubblized oil shale bed. Models predicted an operating time of 20 days, and an estimated oil yield of 89% of Fischer Assay. Large-scale experiments with injection of hot flue gases into beds of oil shale blocks showed considerable coking and cracking, which reduced oil recovery to 68% of Fischer Assay. As with the in situ oil shale retorts, the oil shale rubblization involved in this process limits it to shallow oil shales and is expensive.

Passey et al. describe a process to produce hydrocarbons from organic-rich rocks by carrying out in situ combustion of oil in an adjacent reservoir (REF. 16). The organic-rich rock is heated by thermal conduction from the high temperatures achieved in the adjacent reservoir. Upon heating to temperatures in excess of 250° C., the kerogen in the organic-rich rocks is transformed to oil and gas, which are then produced. The permeability of the organic-rich rock increases as a result of the kerogen transformation. This process is limited to organic-rich rocks that have an oil reservoir in an adjacent formation.

In an in situ retort by electromagnetic heating of the formation, electromagnetic energy passes through the formation, and the rock is heated by electrical resistance or by the absorption of dielectric energy. To our knowledge it has not been applied to oil shale, but field tests have been performed in heavy oil formations.

The technical capability of resistive heating within a subterranean formation has been demonstrated in a heavy-oil pilot test where "electric preheat" was used to flow electric current between two wells to lower viscosity and create communication channels between wells for follow-up with a steam flood (REF. 4). Resistive heating within a subterranean formation has been patented and applied commercially by running alternating current or radio frequency electrical energy between stacked conductive fractures or electrodes in the same well (REF. 14; REF. 6; REF. 15; REF. 12). REF. 7 includes a description of resistive heating within a subterranean formation by running alternating current between different wells. Others have described methods to create an effective electrode in a wellbore (REF. 20; REF. 8). REF. 27 describes a method by which electric current is flowed through a fracture connecting two wells to get electric flow started in the bulk of the surrounding formation; heating of the formation occurs primarily due to the bulk electrical resistance of the formation.

Resistive heating of the formation with low-frequency electromagnetic excitation is limited to temperatures below the in situ boiling point of water to maintain the current-carrying capacity of the rock. Therefore, it is not applicable to kerogen conversion where much higher temperatures are required for conversion on production timeframes.

High-frequency heating (radio or microwave frequency) offers the capability to bridge dry rock, so it may be used to heat to higher temperatures. A small-scale field experiment confirmed that high temperatures and kerogen conversion could be achieved (REF. 2). Penetration is limited to a few meters (REF. 25), so this process would require many wellbores and is unlikely to yield economic success.

In these methods that utilize an electrode to deliver electrical excitation directly to the formation, electrical energy passes through the formation and is converted to heat. One patent proposes thermal heating of a gas hydrate from an electrically conductive fracture proppant in only one well, with current flowing into the fracture and presumably to ground (REF. 9).

Even in view of currently available and proposed technologies, it would be advantageous to have improved methods of treating subterranean formations to convert organic matter into producible hydrocarbons.

Therefore, an object of this invention is to provide such improved methods. Other objects of this invention will be made apparent by the following description of the invention.

SUMMARY OF THE INVENTION

Methods of treating a subterranean formation that contains solid organic matter are provided. In one embodiment, a method according to this invention comprises the steps of: (a) providing one or more wells that penetrate a treatment interval within the subterranean formation; (b) establishing at least one fracture from at least one of said wells, whereby said fracture intersects at least one of said wells; (c) placing electrically conductive material in said fracture; and (d) passing electric current through said fracture such that said current passes through at least a portion of said electrically conductive material and sufficient heat is generated by electrical resistivity within said portion of said electrically conductive material to pyrolyze at least a portion of said solid organic matter into producible hydrocarbons. In one embodiment, said electrically conductive material comprises a proppant. In one embodiment, said electrically conductive material comprises a conductive cement. In one embodiment, one or more of said fractures intersects at least two of said wells. In one embodiment, said subterranean formation comprises oil shale. In one embodiment, said well is substantially vertical. In one embodiment, said well is substantially horizontal. In one embodiment, said fracture is substantially horizontal. In one embodiment, said fracture is substantially vertical. In one embodiment, said fracture is substantially longitudinal to the well from which it is established.

In one embodiment of this invention, a method of treating a subterranean formation that contains solid organic matter is provided wherein said method comprises the steps of: (a) providing one or more wells that penetrate a treatment interval within the subterranean formation; (b) establishing at least one fracture from at least one of said wells, whereby said fracture intersects at least one of said wells; (c) placing electrically conductive proppant material in said fracture; and (d) passing electric current through said fracture such that said current passes through at least a portion of said electrically conductive proppant material and sufficient heat is generated by electrical resistivity within said portion of said electrically conductive proppant material to pyrolyze at least a portion of said solid organic matter into producible hydrocarbons.

In another embodiment, a method of treating a subterranean formation that contains solid organic matter is provided wherein said method comprises the steps of: (a) providing two or more wells that penetrate a treatment interval within the subterranean formation; (b) establishing at least one fracture from at least one of said wells, whereby said fracture intersects at least two of said wells; (c) placing electrically conductive material in said fracture; and (d) passing electric current through said fracture such that said current passes through at least a portion of said electrically conductive material and sufficient heat is generated by electrical resistivity within said portion of said electrically conductive material to pyrolyze at least a portion of said solid organic matter into producible hydrocarbons.

In another embodiment, a method of treating a subterranean formation that contains solid organic matter is provided wherein said method comprises the steps of: (a) providing two or more wells that penetrate a treatment interval within the subterranean formation; (b) establishing at least one fracture from at least one of said wells, whereby said fracture intersects at least two of said wells; (c) placing electrically conductive proppant material in said fracture; and (d) passing electric current through said fracture such that said current passes through at least a portion of said electrically conductive proppant material and sufficient heat is generated by electrical resistivity within said portion of said electrically conductive proppant material to pyrolyze at least a portion of said solid organic matter into producible hydrocarbons.

In another embodiment, a method of treating a heavy oil or tar sand subterranean formation containing hydrocarbons is provided wherein said method comprises the steps of: (a) providing one or more wells that penetrate a treatment interval within the subterranean formation; (b) establishing at least one fracture from at least one of said wells, whereby said fracture intersects at least one of said wells; (c) placing electrically conductive material in said fracture; and (d) passing electric current through said fracture such that said current passes through at least a portion of said electrically conductive material and sufficient heat is generated by electrical resistivity within said portion of said electrically conductive material to reduce the viscosity of at least a portion of said hydrocarbons.

In another embodiment, a method of treating a subterranean formation that contains solid organic matter is provided wherein said method comprises: (a) providing one or more wells that penetrate a treatment interval within the subterranean formation; (b) establishing at least one fracture from at least one of said wells, whereby said fracture intersects at least one of said wells; (c) placing electrically conductive material in said fracture, wherein said electrically conductive material is comprised of a mixture of at least a first material and a second material; (d) placing two electrodes in contact with the electrically conductive material; and (e) applying a voltage across the two electrodes causing an electric current to pass through said fracture such that said current passes through at least a portion of said electrically conductive material and sufficient heat is generated by electrical resistivity within said portion of said electrically conductive material to pyrolyze at least a portion of said solid organic matter into producible hydrocarbons.

In another embodiment, a method of treating a heavy oil or tar sand subterranean formation containing hydrocarbons is provided, wherein said method comprises: (a) providing one or more wells that penetrate a treatment interval within the subterranean formation; (b) establishing at least one fracture from at least one of said wells, whereby said fracture intersects at least one of said wells; (c) placing electrically conductive material in said fracture, wherein said electrically conductive material is comprised of a mixture of at least a first material and a second material; (d) placing two electrodes in contact with the electrically conductive material; and (e) applying a voltage across the two electrodes causing an electric current to pass through said fracture such that said current passes through at least a portion of said electrically conductive material and sufficient heat is generated by electrical resistivity within said portion of said electrically conductive material to reduce the viscosity of at least a portion of said hydrocarbons.

In another embodiment, a method of producing hydrocarbon fluids is provided, wherein the method comprises heating a subterranean formation that contains solid organic matter, thereby pyrolyzing the solid organic matter to form producible hydrocarbons and producing at least a portion of the producible hydrocarbons to the surface, wherein the heating comprises: (a) providing one or more wells that penetrate a treatment interval within the subterranean formation; (b) establishing at least one fracture from at least one of said wells, whereby said fracture intersects at least one of said wells; (c) placing electrically conductive material in said fracture, wherein said electrically conductive material is comprised of a mixture of at least a first material and a second material; (d) placing two electrodes in contact with the electrically conductive material; and (e) applying a voltage across the two electrodes causing an electric current to pass through said fracture such that said current passes through at least a portion of said electrically conductive material and sufficient heat is generated by electrical resistivity within said portion of said electrically conductive material to pyrolyze at least a portion of said solid organic matter into producible hydrocarbons.

In another embodiment, a method of producing hydrocarbon fluids is provided, wherein the method comprises heating a subterranean heavy oil or tar sand formation containing hydrocarbons, thereby reducing the hydrocarbons viscosity, and producing at least a portion of the reduced viscosity hydrocarbons to the surface, wherein the heating comprises: (a) providing one or more wells that penetrate a treatment interval within the subterranean formation; (b) establishing at least one fracture from at least one of said wells, whereby said fracture intersects at least one of said wells; (c) placing electrically conductive material in said fracture, wherein said electrically conductive material is comprised of a mixture of at least a first material and a second material; (d) placing two electrodes in contact with the electrically conductive material; and (e) applying a voltage across the two electrodes causing an electric current to pass through said fracture such that said current passes through at least a portion of said electrically conductive material and sufficient heat is generated by electrical resistivity within said portion of said electrically conductive material to reduce the viscosity of at least a portion of said hydrocarbons, thereby forming reduced viscosity hydrocarbons.

In another embodiment, a method of producing hydrocarbon fluids is provided, wherein the method comprises heating a subterranean formation that contains organic matter comprised of solid organic matter, heavy oil, tar sands, or combinations thereof, thereby pyrolyzing or reducing the viscosity of at least a portion of the organic matter, forming producible hydrocarbons and producing at least a portion of the producible hydrocarbons to the surface, wherein the heating comprises: (a) providing one or more wells that penetrate a treatment interval within the subterranean formation; (b) establishing at least one fracture from at least one of said wells, whereby said fracture intersects at least one of said wells; (c) placing electrically conductive material in said fracture, wherein said electrically conductive material is comprised of a mixture of at least a first material and a second material; (d) placing two electrodes in contact with the electrically conductive material; and (e) applying a voltage across the two electrodes causing an electric current to pass through said fracture such that said current passes through at least a portion of said electrically conductive material and sufficient heat is generated by electrical resistivity within said portion of said electrically conductive material to pyrolyze at least a portion of said solid organic matter into producible hydrocarbons.

This invention uses an electrically conductive material as a resistive heater. Electrical current flows primarily through the resistive heater comprised of the electrically conductive material. Within the resistive heater, electrical energy is converted to thermal energy, and that energy is transported to the formation by thermal conduction.

Broadly, the invention is a process that generates hydrocarbons from organic-rich rocks (i.e., source rocks, oil shale). The process utilizes electric heating of the organic-rich rocks. An in situ electric heater is created by delivering electrically conductive material into a fracture in the organic matter containing formation in which the process is applied. In describing this invention, the term "hydraulic fracture" is used. However, this invention is not limited to use in hydraulic fractures. The invention is suitable for use in any fracture, created in any manner considered to be suitable by one skilled in the art. In one embodiment of this invention, as will be described along with the drawings, the electrically conductive material may comprise a proppant material; however, this invention is not limited thereto. FIG. 1 shows an example application of the process in which heat 10 is delivered via a substantially horizontal hydraulic fracture 12 propped with essentially sand-sized particles of an electrically conductive material (not shown in FIG. 1). A voltage 14 is applied across two wells 16 and 18 that penetrate the fracture 12. An AC voltage 14 is preferred because AC is more readily generated and minimizes electrochemical corrosion, as compared to DC voltage. However, any form of electrical energy, including without limitation, DC, is suitable for use in this invention. Propped fracture 12 acts as a heating element; electric current passed through it generates heat 10 by resistive heating. Heat 10 is transferred by thermal conduction to organic-rich rock 15 surrounding fracture 12. As a result, organic-rich rock 15 is heated sufficiently to convert kerogen contained in rock 15 to hydrocarbons. The generated hydrocarbons are then produced using well-known production methods. FIG. 1 depicts the process of this invention with a single horizontal hydraulic fracture 12 and one pair of vertical wells 16, 18. The process of this invention is not limited to the embodiment shown in FIG. 1. Possible variations include the use of horizontal wells and/or vertical fractures. Commercial applications might involve multiple fractures and several wells in a pattern or line-drive formation. The key feature distinguishing this invention from other treatment methods for formations that contain organic matter is that an in situ heating element is created by the delivery of electric current through a fracture containing electrically conductive material such that sufficient heat is generated by electrical resistivity within the material to pyrolyze at least a portion of the organic matter into producible hydrocarbons.

Any means of generating the voltage/current through the electrically conductive material in the fractures may be employed, as will be familiar to those skilled in the art. Although variable with organic-rich rock type, the amount of heating required to generate producible hydrocarbons, and the corresponding amount of electrical current required, can be estimated by methods familiar to those skilled in the art. Kinetic parameters for Green River oil shale, for example, indicate that for a heating rate of 100° C. (180° F.) per year, complete kerogen conversion will occur at a temperature of about 324° C. (615° F.). Fifty percent conversion will occur at a temperature of about 291° C. (555° F.). Oil shale near the fracture will be heated to conversion temperatures within months, but it is likely to require several years to attain thermal penetration depths required for generation of economic reserves.

During the thermal conversion process, oil shale permeability is likely to increase. This may be caused by the increased pore volume available for flow as solid kerogen is converted to liquid or gaseous hydrocarbons, or it may result from the formation of fractures as kerogen converts to hydrocarbons and undergoes a substantial volume increase within a confined system. If initial permeability is too low to allow release of the hydrocarbons, excess pore pressure will eventually cause fractures.

The generated hydrocarbons may be produced via the same wells by which the electric power is delivered to the conductive fracture, or additional wells may be used. Any method of producing the producible hydrocarbons may be used, as will be familiar to those skilled in the art.

DESCRIPTION OF THE DRAWINGS

The advantages of the present invention will be better understood by referring to the following detailed description and the attached drawings in which.

While the invention will be described in connection with its preferred embodiments, it will be understood that the invention is not limited thereto. On the contrary, the invention is intended to cover all alternatives, modifications, and equivalents which may be included within the spirit and scope of the present disclosure, as defined by the appended claims.

DETAILED DESCRIPTION OF THE INVENTION

Figure 1:
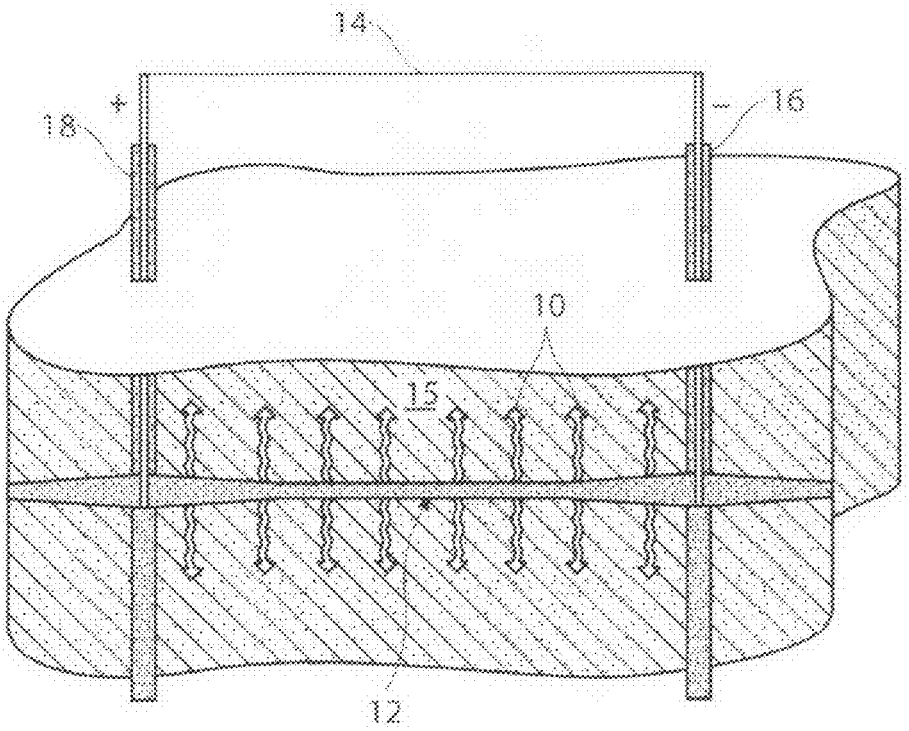
FIG. 1 illustrates one embodiment of this invention.
Figure 2:
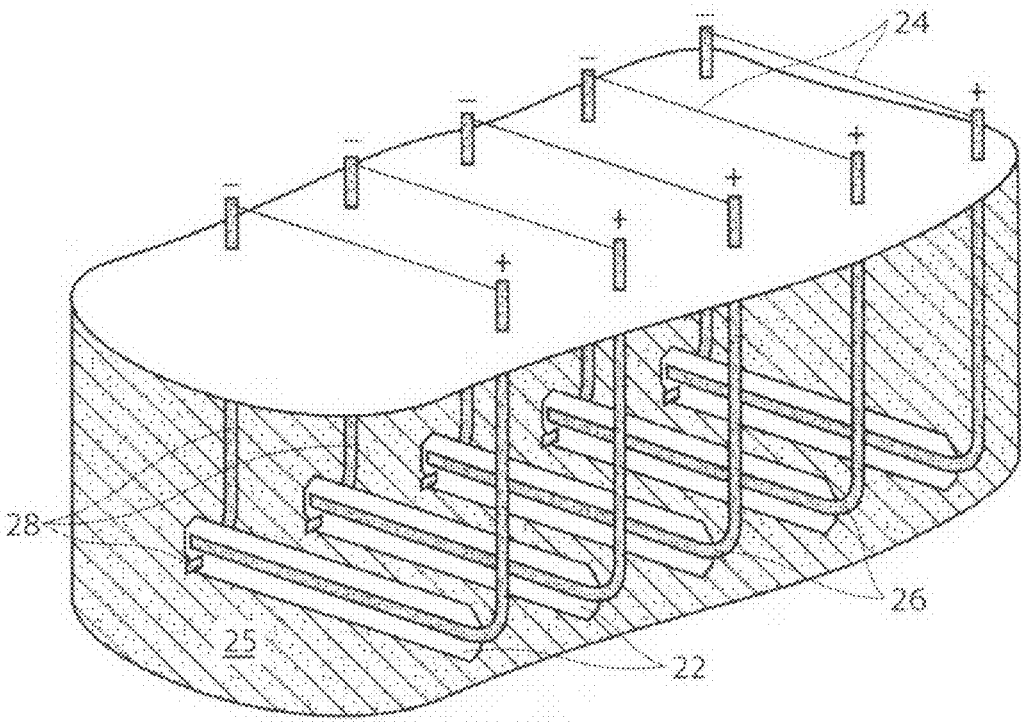
FIG. 2 illustrates another embodiment of this invention.

Referring now to FIG. 2, a preferred embodiment of this invention is illustrated. FIG. 2 shows an example application of the process in which heat is delivered via a plurality of substantially vertical hydraulic fractures 22 propped with particles of an electrically conductive material (not shown in FIG. 2). Each hydraulic fracture 22 is longitudinal to the well from which it is established. A voltage 24 is applied across two or more wells 26, 28 that penetrate the fractures 22. In this embodiment, wells 26 are substantially horizontal and wells 28 are substantially vertical. An AC voltage 24 is preferred because AC is more readily generated and minimizes electrochemical corrosion, as compared to DC voltage. However, any form of electrical energy, including without limitation, DC, is suitable for use in this invention. As shown in FIG. 2, in this embodiment the positive ends of the electrical circuits generating voltage 24 are at wells 26 and the negative ends of the circuits are at wells 28. Propped fractures 22 act as heating elements; electric current passed through propped fractures 22 generate heat by resistive heating. This heat is transferred by thermal conduction to organic-rich rock 25 surrounding fractures 22. As a result, organic-rich rock 25 is heated sufficiently to convert kerogen contained in rock 25 to hydrocarbons. The generated hydrocarbons are then produced using well-known production methods. Using this embodiment of the invention, as compared to the embodiment illustrated in FIG. 1, a greater volume of organic-rich rock can be heated and the heating can be made more uniform, causing a smaller volume of organic-rich rock to be heated in excess of what is required for complete kerogen conversion. The embodiment illustrated in FIG. 2 is not intended to limit any aspect of this invention.

Fractures into which conductive material is placed may be substantially vertical or substantially horizontal. Such a fracture may be, but is not required to be, substantially longitudinal to the well from which it is established.

Any suitable materials may be used as the electrically conducting fracture proppant. To be suitable, a candidate material preferably meets several criteria, as will be familiar to those skilled in the art. The electrical resistivity of the proppant bed under anticipated in situ stresses is preferably high enough to provide resistive heating while also being low enough to conduct the planned electric current from one well to another. The proppant material also preferably meets the usual criteria for fracture proppants: e.g., sufficient strength to hold the fracture open, and a low enough density to be pumped into the fracture. Economic application of the process may set an upper limit on acceptable proppant cost. Any suitable proppant material or electrically conductive material may be used, as will be familiar to those skilled in the art. Three suitable classes of proppant comprise (i) thinly metal-coated sands, (ii) composite metal/ceramic materials, and (iii) carbon based materials. A suitable class of non-proppant electrically conductive material comprises conductive cements. More specifically, green or black silicon carbide, boron carbide, or calcined petroleum coke may be used as a proppant. One skilled in the art has the ability to select a suitable proppant or non-proppant electrically conductive material for use in this invention. The electrically conductive material is not required to be homogeneous, but may comprise a mixture of two or more suitable electrically conductive materials. Further, the electrically conductive material may be comprised of a mixture of one electrically conductive material and one substantially non-electrically conductive material.

In some embodiments where the first material comprising the electrically conductive material is itself an electrically conductive material, the second material may be either electrically conductive or substantially non-electrically conductive. An electrically conductive second material may be chosen to aid in maintaining a dispersed electrical connection throughout a substantial portion of the entire fracture pack area. For example, the first material may be an electrically conductive substantially spherical proppant material and the second material may be an elongated electrically conductive material. The phrase elongated material is meant to refer to a material that has an average length that is at least 2.0 times greater than the materials average width. In alternative embodiments, an elongated material may have an average length that is at least 5.0, 10.0, or 15.0 times greater than the materials average width. Where the elongated material is also electrically conductive, the elongated material may function to help maintain a dispersed electricity flow through a large portion of the fracture pack by functioning as an electrical connection between individual electrically conductive proppants. Thus the electrically conductive elongated material may help in establishing and/or maintaining electricity flow through a greater portion of the mass of the electrically conductive proppant material comprising the fracture pack. The elongated material may also function to maintain the structural integrity of the electrically conductive fracture pack area. Heating and/or fluid flow within or near the fracture may produce forces that will tend to move portions of the fracture pack fill material. An elongated material, together with a substantially spherical proppant material will tend to form a composite fracture pack fill material that is more resistant to displacement than a spherical proppant material alone. The above-described displacement resistance of the composite fracture pack fill material is also applicable where the elongated material is substantially non-electrically conductive. The elongated material may preferably have a minimum flexibility so that the material will flex but not break during pumping and during heating operations. Exemplary elongated materials include fibers, wirelets, shavings, ductile platelets or combinations thereof. An electrically conductive elongated material may be comprised of metal.

The first material and second material of the composite fracture pack material may be delivered and packed in any selected proportion. In some embodiments employing a substantially spherical proppant material together with an elongated material, the elongated material length may be up to 30 times or more the proppant average grain size. In alternate embodiments, the elongated material length may be between 1 to 30 times, 2 to 20 times, or 10 to 15 times the average proppant grain size. In some embodiments employing a substantially spherical proppant material together with an elongated material, the elongated material may have an average width that is less than about 50 percent of the average grain size of the proppant material. In alternate embodiments, the elongated material may have an average width that is less than about 40, 35 or 30 percent of the average grain size of the proppant material. In some embodiments employing an elongated material as part of a composite fracture pack material, the width of the elongated material, or second material, may be less than about 125 percent of the average pore size of a fracture pack made up of only the first material (e.g., substantially spherical proppant material). In alternate embodiments, the width of the elongated material may be less than about 100, 95, or 90 percent of the average pore size of a fracture pack made up of only the first material. In some embodiments including an elongated material, the substantially spherical proppant material may comprise 60 to 99.9 weight percent of the composite fracture pack mass. In alternate embodiments, the substantially spherical proppant material may comprise 70 to 99, 75 to 99 or 80 to 99 weight percent of the composite fracture pack mass. In some embodiments the elongated material may comprise 0.1 to 40 weight percent of the composite fracture pack mass. In alternate embodiments, the elongated material may comprise 0.5 to 30, 1.0 to 25 or 2.0 to 20 weight percent of the composite fracture pack mass.

Figure 4:
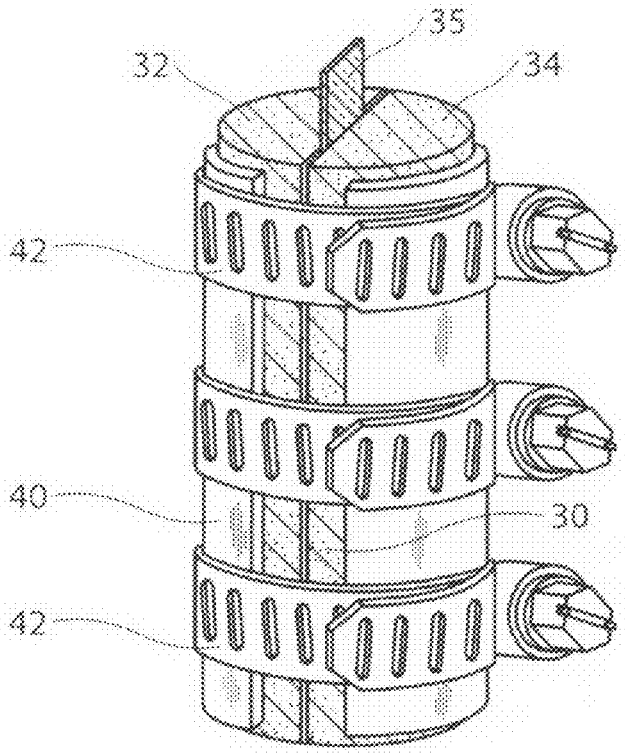

FIG. 4 depicts a composite fracture pack material comprised of a substantially spherical proppant material and an elongated wirelet material. With reference to FIG. 4, fracture pack material 80 is comprised of substantially spherical proppant 81 mixed with elongated wirelet material 82. It can be seen that the wirelet material 82 is interspersed within the proppant material 81 so as to provide the opportunity for both enhanced electrical connectivity within the fracture pack mass 80 and enhanced stability of the composite fracture pack mass 80. In particular, the elongated wirelet material 82 touches multiple substantially spherical proppant particles 81 and may entangle with other elongated wirelets 82.

In some embodiments where the first material comprising the electrically conductive material is itself an electrically conductive material, the second material may be either an electrically conductive or substantially non-electrically conductive cement. Cement, by itself, may be essentially non-electrically conductive. However, electrically conductive materials, including for example graphite, may be added to cement to make the cement more electrically conductive. In the case where the second material is a cement, the cement material may function to maintain the structural integrity of the electrically conductive fracture pack area. As previously discussed, heating and/or fluid flow within or near the fracture may produce forces that will tend to move portions of the fracture pack fill material. A cement material, together with a substantially spherical proppant material will tend to form a composite fracture pack fill material that is more resistant to displacement than a spherical proppant material alone. Exemplary conductive cement materials include those previously discussed. Exemplary substantially non-electrically conductive cement materials include Portland cement, silica, clay-based cements, or combinations thereof.

The first material and second material of the composite fracture pack material may be delivered and packed in any selected proportion. In some embodiments employing a non-electrically conductive fracture pack material, the electrically conductive material may comprise 50 to 99.9 weight percent of the composite fracture pack mass. In alternate embodiments, the electrically conductive material may comprise 50 to 99, 60 to 99 or 70 to 99 weight percent of the composite fracture pack mass. In some embodiments employing a non-electrically conductive fracture pack material, the non-electrically conductive material may comprise 0.1 to 50 weight percent of the composite fracture pack mass. In alternate embodiments, the non-electrically conductive material may comprise 0.1 to 40, 0.1 to 30 or 0.1 to 20 weight percent of the composite fracture pack mass. In some embodiments employing a cement material as part of a composite fracture pack material, the volume of cement material, or second material, may be less than about 125 percent of the average porosity of a fracture pack made up of only the first material (e.g., substantially spherical proppant material). In alternate embodiments, the cement material may be less than about 100, 95, or 90 percent of the average porosity of a fracture pack made up of only the first material. In some embodiments employing a cement material and a substantially spherical proppant material, the substantially spherical proppant material may comprise 40 to 99.9 weight percent of the composite fracture pack mass. In alternate embodiments, the substantially spherical proppant material may comprise 50 to 99, 60 to 99 or 70 to 99 weight percent of the composite fracture pack mass. In some embodiments employing a cement material as part of a composite fracture pack material, the cement material may comprise 1 to 50 weight percent of the composite fracture pack mass. In alternate embodiments, the cement material may comprise 1 to 40, 5 to 30 or 10 to 25 weight percent of the composite fracture pack mass. In some embodiments employing a cement fracture pack material, the second material (e.g., electrically conductive propant material, calcined coke) may comprise 50 to 99.9 weight percent of the composite fracture pack mass. In alternate embodiments, the second material may comprise 60 to 99, 70 to 99 or 80 to 99 weight percent of the composite fracture pack mass.

The composite fracture pack may be placed in the fracture as other fracture packs are generally completed, as is known in the art. For example, the first material and the second material may be mixed with an appropriate carrier fluid having sufficient viscosity to carry the mixture of materials at a chosen fracture volume and fracture packing flow rate. Methods useful in mixing and flowing cement for well casing operations and methods useful in mixing and accomplishing fracture packing operations, as are known in the art, may be used for accomplishing the above composite fracture packing methods.

EXAMPLE

Figure 3:
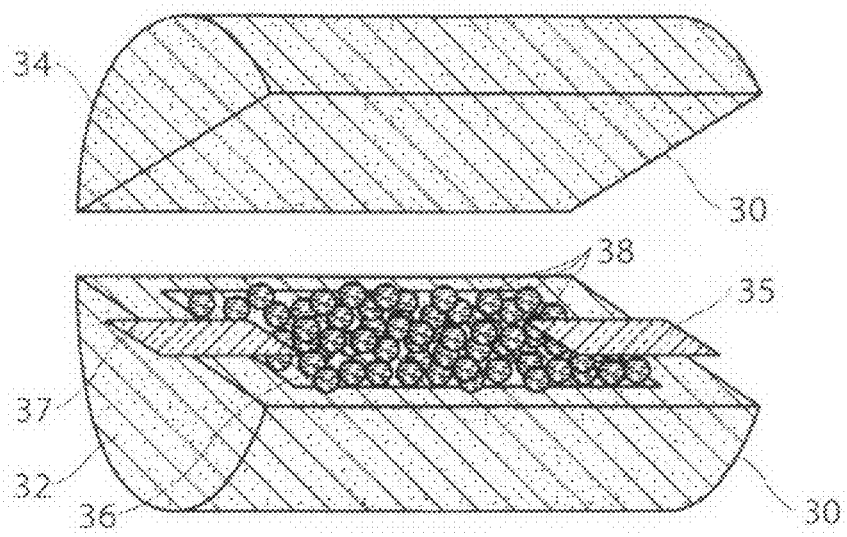
FIG. 3, FIG. 4, and FIG. 5, illustrate a laboratory experiment conducted to test a method according to this invention.

A laboratory test was conducted and the test results show that this invention successfully transforms kerogen in a rock into producible hydrocarbons in the laboratory. Referring now to FIG. 3 and FIG. 4, a core sample 30 was taken from a kerogen-containing subterranean formation. As illustrated in FIG. 3, core sample 30 was cut into two portions 32 and 34. A tray 36 having a depth of about 0.25 mm (1/16 inch) was carved into sample portion 32 and a proxy proppant material 38 (#170 cast steel shot having a diameter of about 0.1 mm (0.02 inch)) was placed in tray 36. As illustrated, a sufficient quantity of proppant material 38 to substantially fill tray 36 was used. Electrodes 35 and 37 were placed in contact with proppant material 38, as shown. As shown in FIG. 4, sample portions 32 and 34 were placed in contact, as if to reconstruct core sample 30, and placed in a stainless steel sleeve 40 held together with three stainless steel hose clamps 42. The hose clamps 42 were tightened to apply stress to the proxy proppant (not seen in FIG. 4), just as the proppant would be required to support in situ stresses in a real application. A thermocouple (not shown in the FIGs.) was inserted into core sample 30 about mid-way between tray 36 and the outer diameter of core sample 30. The resistance between electrodes 35 and 37 was measured at 822 ohms before any electrical current was applied.

The entire assembly was then placed in a pressure vessel (not shown in the FIGs.) with a glass liner that would collect any generated hydrocarbons. The pressure vessel was equipped with electrical feeds. The pressure vessel was evacuated and charged with Argon at 500 psi to provide a chemically inert atmosphere for the experiment. Electrical current in the range of 18 to 19 amps was applied between electrodes 35 and 37 for 5 hours. The thermocouple in core sample 30 measured a temperature of 268° C. after about 1 hour and thereafter tapered off to about 250° C. Using calculation techniques that are well known to those skilled in the art, the high temperature reached at the location of tray 36 was from about 350° C. to about 400° C.

After the experiment was completed and the core sample 30 had cooled to ambient temperature, the pressure vessel was opened and 0.15 ml of oil was recovered from the bottom of the glass liner within which the experiment was conducted. The core sample 30 was removed from the pressure vessel, and the resistance between electrodes 35 and 37 was again measured. This post-experiment resistance measurement was 49 ohms.

Figure 5:
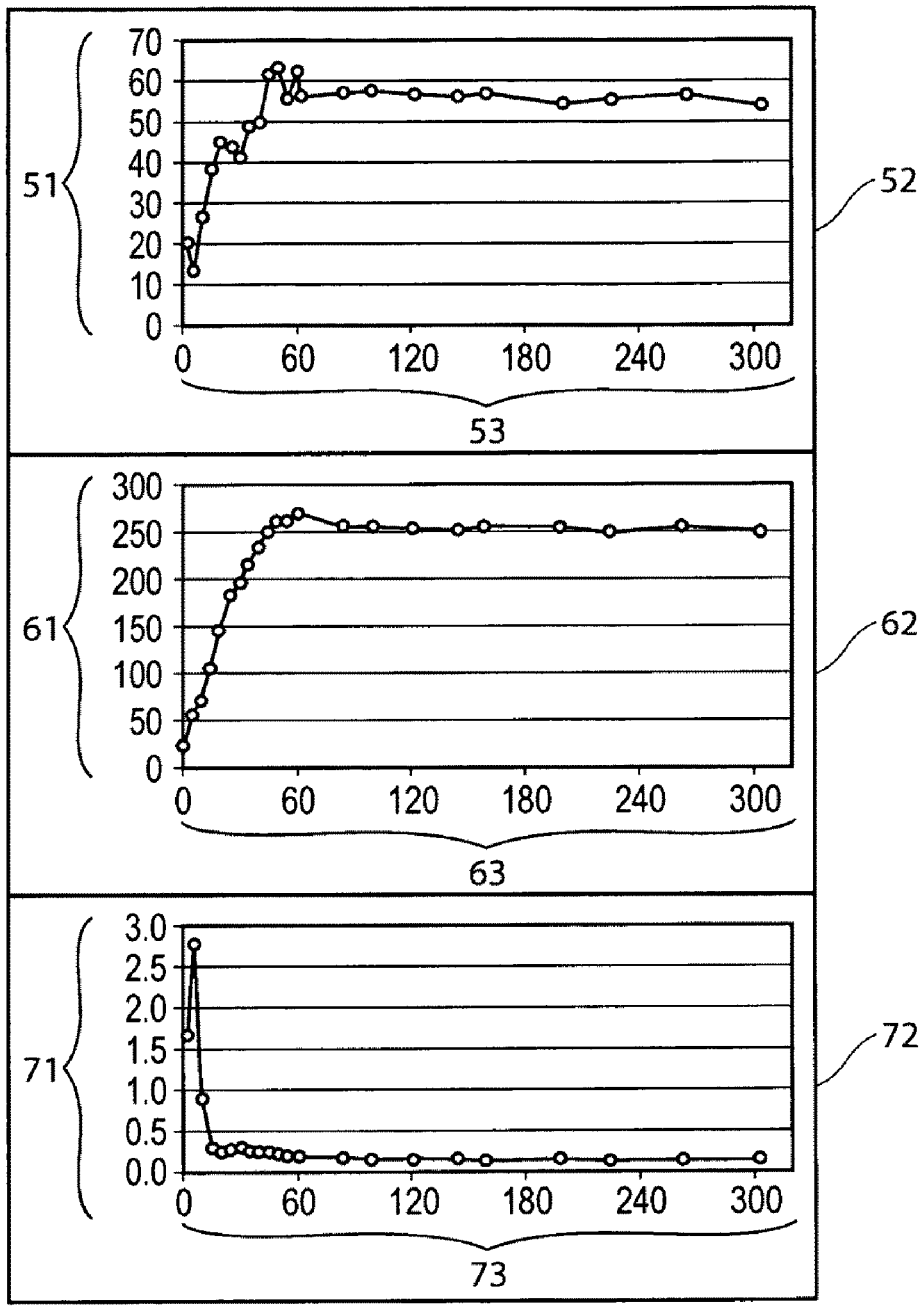
Figure 6:
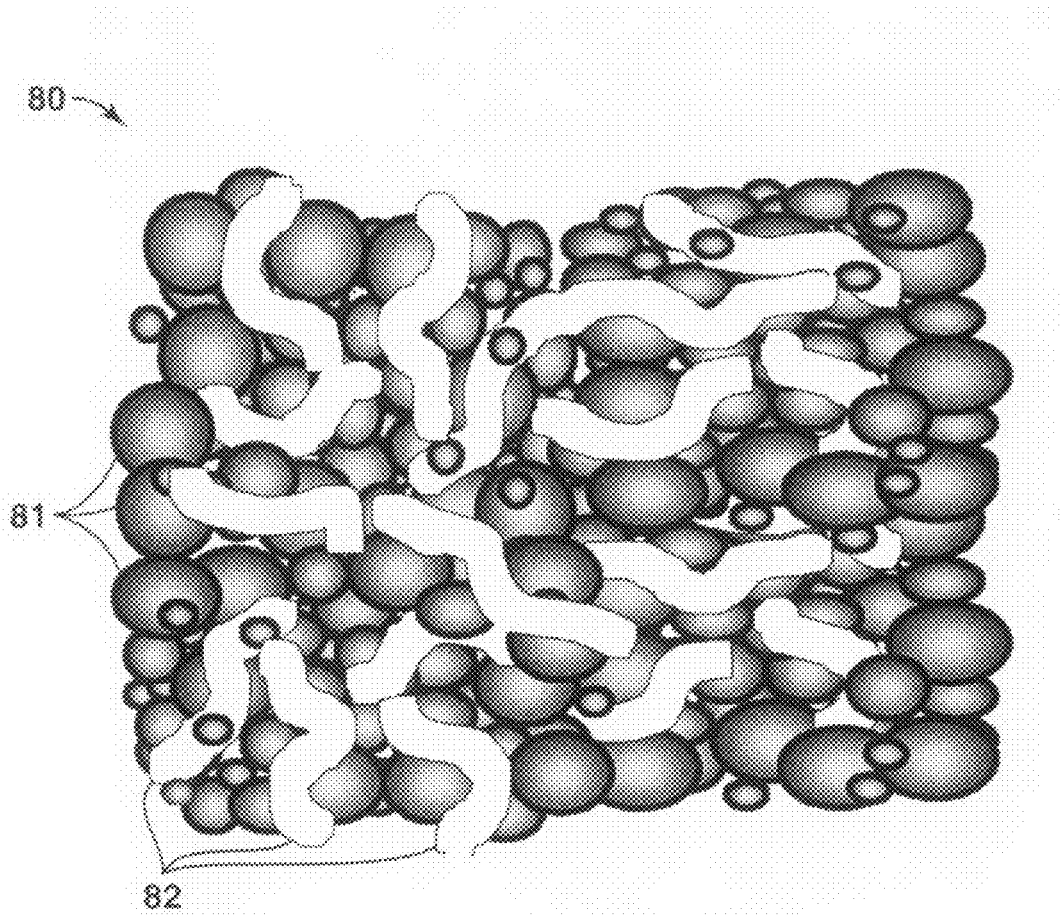
FIG. 6 illustrates one embodiment of the invention that uses a mixture of two materials to form a fracture pack material.

FIG. 5 includes (i) chart 52 whose ordinate 51 is the electrical power, in watts, consumed during the experiment, and whose abscissa 53 shows the elapsed time in minutes during the experiment; (ii) chart 62 whose ordinate 61 is the temperature in degrees Celsius measured at the thermocouple in the core sample 30 (FIGS. 3 and 4) throughout the experiment, and whose abscissa 63 shows the elapsed time in minutes during the experiment; and (iii) chart 72 whose ordinate 71 is the resistance in ohms measured between electrodes 35 and 37 (FIGS. 3 and 4) during the experiment, and whose abscissa 73 shows the elapsed time in minutes during the experiment. Only resistance measurements made during the heating experiment are included in chart 72, the pre-experiment and post-experiment resistance measurements (822 and 49 ohms) are omitted.

After the core sample 30 cooled to ambient temperature, it was removed from the pressure vessel and disassembled. The proxy proppant 38 was observed to be impregnated in several places with tar-like hydrocarbons or bitumen, which were generated from the oil shale during the experiment. A cross section was taken through a crack that developed in the core sample 30 because of thermal expansion during the experiment. A crescent shaped section of converted oil shale adjacent to the proxy proppant 38 was observed.

Although this invention is applicable to transforming solid organic matter into producible hydrocarbons in oil shale, this invention may also be applicable to heavy oil reservoirs, or tar sands. In these instances, the electrical heat supplied would serve to reduce hydrocarbon viscosity. Additionally, while the present invention has been described in terms of one or more preferred embodiments, it is to be understood that other modifications may be made without departing from the scope of the invention, which is set forth in the claims below.

TABLE OF REFERENCES

REF. 1: Berry, K. L., Hutson, R. L., Sterrett, J. S., and Knepper, J. C., 1982, Modified in situ retorting results of two field retorts, Gary, J. H., ed., 15th Oil Shale Symp., CSM, p. 385-396.

REF. 2: Bridges, J. E., Krstansky, J. J., Taflove, A., and Sresty, G., 1983, The IITRI in situ fuel recovery process, J. Microwave Power, v. 18, p. 3-14.

REF. 3: Bouck, L. S., 1977, Recovery of geothermal energy, U.S. Pat. No. 4,030,549.

REF. 4: Chute, F. S., and Vermeulen, F. E., 1988, Present and potential applications of electromagnetic heating in the in situ recovery of oil, AOSTRA J. Res., v. 4, p. 19-33.

REF. 5: Covell, J. R., Fahy, J. L., Schreiber, J., Suddeth, B. C., and Trudell, L., 1984, Indirect in situ retorting of oil shale using the TREE process, Gary, J. H., ed., 17th Oil Shale Symposium Proceedings, Colorado School of Mines, p. 46-58.

REF. 6: Crowson, F. L., 1971, Method and apparatus for electrically heating a subsurface formation, U.S. Pat. No. 3,620,300.

REF. 7: Gill, W. G., 1972, Electrical method and apparatus for the recovery of oil, U.S. Pat. No. 3,642,066.

REF. 8: Gipson, L. P., and Montgomery, C. T., 1997, Method for increasing the production of petroleum from a subterranean formation penetrated by a wellbore, U.S. Pat. No. 5,620,049.

REF. 9: Gipson, L. P., and Montgomery, C. T., 2000, Method of treating subterranean gas hydrate formations, U.S. Pat. No. 6,148,911.

REF. 10: Humphrey, J. P., 1978, Energy from in situ processing of Antrim oil shale, DOE Report FE-2346-29.

REF. 11: Lekas, M. A., Lekas, M. J., and Strickland, F. G., 1991, Initial evaluation of fracturing oil shale with propellants for in situ retorting—Phase 2, DOE Report DOE/MC/11076-3064.

REF. 12: Little, W. E., and McLendon, T. R., 1987, Method for in situ heating of hydrocarbonaceous formations, U.S. Pat. No. 4,705,108.

REF. 13: Oil & Gas Journal, 1998, Aussie oil shale project moves to Stage 2, Oct. 26, p. 42.

REF. 14: Orkiszewski, J., Hill, J. L., McReynolds, P. S., and Boberg, T. C., 1964, Method and apparatus for electrical heating of oil-bearing formations, U.S. Pat. No. 3,149,672.

REF. 15: Osborne, J. S., 1983, In situ oil shale process, U.S. Pat. No. 4,401,162.

REF. 16: Passey, Q. R., Thomas, M. M., and Bohacs, K. M., 2001, WO 01/81505.

REF. 17: Pittman, R. W., Fontaine, M. F., 1984, In situ production of hydrocarbons including shale oil, U.S. Pat. No. 4,487,260.

REF. 18: Riva, D. and Hopkins, P., 1998, Suncor down under: the Stuart Oil Shale Project, Annual Meeting of the Canadian Inst. of Mining, Metallurgy, and Petroleum, Montreal, May 3-7.

REF. 19: Salamonsson, G., 1951, The Ljungstrom in situ method for shale-oil recovery, Sell, G., ed., Proc. of the 2nd Oil Shale and Cannel Coal Conf., v. 2, Glasgow, July 1950, Institute of Petroleum, London, p. 260-280.

REF. 20: Segalman, D. J., 1986, Electrode well method and apparatus, U.S. Pat. No. 4,567,945.

REF. 21: Stevens, A. L., and Zahradnik, R. L., 1983, Results from the simultaneous processing of modified in situ retorts 7& 8, Gary, J. H., ed., 16th Oil Shale Symp., CSM, p. 267-280.

REF. 22: Tissot, B. P., and Welte, D. H., 1984, Petroleum Formation and Occurrence, New York, Springer-Verlag, p. 699.

REF. 23: Tyner, C. E., Parrish, R. L., and Major, B. H., 1982, Sandia/Geokinetics Retort 23: a horizontal in situ retorting experiment, Gary, J. H., ed., 15th Oil Shale Symp., CSM, p. 370-384.

REF. 24: Van Meurs, P., DeRouffiguan, E. P., Vinegar, H. J., and Lucid, M. F., 1989, Conductively heating a subterranean oil shale to create permeability and subsequently produce oil, U.S. Pat. No. 4,886,118.

REF. 25: Vermeulen, F. E., 1989, Electrical heating of reservoirs, Hepler, L., and Hsi, C., eds., AOSTRA Technical Handbook on Oil Sands, Bitumens, and Heavy Oils, Chapt. 13, p. 339-376.

REF. 26: Yen, T. F., and Chilingarian, G. V., 1976, Oil Shale, Amsterdam, Elsevier, p. 292.

REF. 27: Parker, H. W. 1960, In Situ Electrolinking of Oil Shale, U.S. Pat. No. 3,137,347.

We claim:

1. A method of treating a subterranean formation that contains solid organic matter, said method comprising:

(a) providing one or more wells that penetrate a treatment interval within the subterranean formation;

(b) establishing at least one fracture from at least one of said wells, whereby said fracture intersects at least one of said wells;

(c) placing electrically conductive material in said fracture, wherein said electrically conductive material is comprised of a mixture of at least a first material and a second material, wherein the first material comprises substantially non-electrically conductive cement;

(d) placing two electrodes in contact with the electrically conductive material; and (e) applying a voltage across the two electrodes causing an electric current to pass through said fracture such that said current passes through at least a portion of said electrically conductive material and sufficient heat is generated by electrical resistivity within said portion of said electrically conductive material to pyrolyze at least a portion of said solid organic matter into producible hydrocarbons.

2. The method of claim 1 wherein said subterranean formation comprises oil shale.

3. The method of claim 2, wherein the second material is an electrically conductive proppant material.

4. The method of claim 2, wherein the second material comprises is an elongated material.

5. The method of claim 4, wherein the second material comprises is a fiber, wirelet, shaving, or platelet.

6. The method of claim 5, wherein the second material is electrically conductive.

7. The method of claim 6, wherein the second material is comprised of a metallic material.

8. The method of claim 4, wherein the elongated material has an average length that is between 5 and 30 times the average grain size of the proppant material.

9. The method of claim 4, wherein the elongated material has an average width that is less than 50 percent of the average grain size of the proppant material.

10. The method of claim 1, wherein the second material is an electrically conductive proppant material.

11. The method of claim 1, wherein said subterranean formation comprises heavy oil or tar sand.

12. A method of treating a heavy oil or tar sand subterranean formation containing hydrocarbons, said method comprising:

(a) providing one or more wells that penetrate a treatment interval within the subterranean formation;

(b) establishing at least one fracture from at least one of said wells, whereby said fracture intersects at least one of said wells;

(c) placing electrically conductive material in said fracture, wherein said electrically conductive material is comprised of a mixture of at least a first material and a second material, wherein the first material comprises cement and the second material comprises an electrically conductive proppant material;

(d) placing two electrodes in contact with the electrically conductive material; and (e) applying a voltage across the two electrodes causing an electric current to pass through said fracture such that said current passes through at least a portion of said electrically conductive material and sufficient heat is generated by electrical resistivity within said portion of said electrically conductive material to reduce the viscosity of at least a portion of said hydrocarbons.

13. The method of claim 12, wherein the cement is substantially non-electrically conductive.

14. The method of claim 12, wherein the second material comprises an elongated material.

15. The method of claim 14, wherein the second material comprises a fiber, wirelet, shaving, or platelet.

16. The method of claim 15, wherein the second material is electrically conductive.

17. The method of claim 16, wherein the second material is comprised of a metallic material.

18. The method of claim 14, wherein the elongated material has an average length that is between 5 and 30 times the average grain size of the proppant material.

19. The method of claim 14, wherein the elongated material has an average width that is less than 50 percent of the average grain size of the proppant material.

20. A method of producing hydrocarbon fluids, comprising:

heating a subterranean formation that contains organic matter comprised of solid organic matter, heavy oil, tar sands, or combinations thereof, wherein the heating comprises:

(a) providing one or more wells that penetrate a treatment interval within the subterranean formation, (b) establishing at least one fracture from at least one of said wells, whereby said fracture intersects at least one of said wells;

(c) placing electrically conductive material in said fracture, wherein said electrically conductive material is comprised of a mixture of at least a first material and a second material, wherein the first material comprises a substantially non-electrically conductive cement;

(d) placing two electrodes in contact with the electrically conductive material; and (e) applying a voltage across the two electrodes causing an electric current to pass through said fracture such that said current passes through at least a portion of said electrically conductive material and sufficient heat is generated by electrical resistivity within said portion of said electrically conductive material to pyrolyze or reduce the viscosity of at least a portion of said organic matter thereby forming producible hydrocarbons; and producing at least a portion of the producible hydrocarbons to the surface.

21. The method of claim 20, wherein the subterranean formation is an oil shale formation.

22. The method of claim 20, wherein said subterranean formation comprises heavy oil or tar sand.

23. A method of treating a subterranean formation that contains solid organic matter, said method comprising:

(a) providing one or more wells that penetrate a treatment interval within the subterranean formation;

(b) establishing at least one fracture from at least one of said wells, whereby said fracture intersects at least one of said wells;

(c) placing electrically conductive material in said fracture, wherein said electrically conductive material is comprised of a mixture of at least a first material and a second material, wherein the first material is cement and the second material is an electrically conductive proppant material;

(d) placing two electrodes in contact with the electrically conductive material; and (e) applying a voltage across the two electrodes causing an electric current to pass through said fracture such that said current passes through at least a portion of said electrically conductive material and sufficient heat is generated by electrical resistivity within said portion of said electrically conductive material to pyrolyze at least a portion of said solid organic matter into producible hydrocarbons.

24. The method of claim 23, wherein said subterranean formation comprises oil shale.

25. The method of claim 23, wherein the cement is substantially non-electrically conductive.

26. The method of claim 23, wherein the second material comprises an elongated material.

27. The method of claim 26, wherein the second material is electrically conductive.

28. The method of claim 26, wherein the elongated material has an average length that is between 5 and 30 times the average grain size of the proppant material.

29. The method of claim 26, wherein the elongated material has an average width that is less than 50 percent of the average grain size of the proppant material.

30. The method of claim 23, wherein the second material comprises a fiber, wirelet, shaving, or platelet.

31. The method of claim 23, wherein the second material comprises a metallic material.

* * * * *